US010774804B2

(12) United States Patent
Klatt et al.

(10) Patent No.: US 10,774,804 B2
(45) Date of Patent: Sep. 15, 2020

(54) METHOD FOR STARTING A COMBUSTION ENGINE

(71) Applicant: Andreas Stihl AG & Co. KG, Waiblingen (DE)

(72) Inventors: Clemens Klatt, Berglen (DE); Johannes Lang, Korb (DE); Michael Unterkircher, Uhingen (DE); Ulf Bannick, Stuttgart (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 0 days.

(21) Appl. No.: 16/532,034

(22) Filed: Aug. 5, 2019

(65) Prior Publication Data

US 2020/0040863 A1 Feb. 6, 2020

(30) Foreign Application Priority Data

Aug. 3, 2018 (EP) ..... 18187393

(51) Int. Cl.
*F02P 5/15* (2006.01)
*F02B 63/02* (2006.01)
*F02N 3/02* (2006.01)

(52) U.S. Cl.
CPC ..... *F02P 5/1506* (2013.01); *F02B 63/02* (2013.01); *F02N 3/02* (2013.01); *F02N 2200/022* (2013.01)

(58) Field of Classification Search
CPC ..... F02P 5/1506; F02P 9/005; F02B 63/02; F02N 3/02; F02N 2200/022;
(Continued)

(56) References Cited

U.S. PATENT DOCUMENTS 5,447,131 A 9/1995 Nickel et al.
2002/0137597 A1* 9/2002 Genise ..... F02D 41/022 477/107

(Continued)

FOREIGN PATENT DOCUMENTS

DE 4326010 A1 2/1995
DE 102008064008 A1 7/2009

(Continued)

*Primary Examiner* — Xiao En Mo

(74) *Attorney, Agent, or Firm* — Walter Ottesen, P.A.

(57) ABSTRACT

A method is for the safe starting of a combustion engine in a handheld, portable work apparatus. When starting, start rpm limiting is activated when the rotational speed of the combustion engine exceeds an activation rotational speed that lies above the coupling rotational speed of a centrifugal coupling. After activating the start rpm limiting for at least one working cycle, an intervention in the ignition is carried out such that the rotational speed of the combustion engine decreases. After the rotational speed has decreased below a lower engagement rotational speed, an intervention in the ignition is carried out such that the rotational speed increases. If the rotational speed exceeds an upper engagement rotational speed, an intervention in the ignition is again carried out such that the rotational speed decreases. The upper engagement rotational speed and/or the lower engagement rotational speed is/are changed with an increasing number of consecutive working cycles.

18 Claims, 6 Drawing Sheets

(58) Field of Classification Search
CPC .. F02N 15/026; F02D 41/042; F02D 2400/06;
F02D 31/001; F02D 41/062
See application file for complete search history.

(56) References Cited

U.S. PATENT DOCUMENTS

| | | | |
|---|---|---|---|
| 2009/0178648 | A1 | 7/2009 | Gegg et al. |
| 2010/0012084 | A1 | 1/2010 | Andersson et al. |
| 2012/0193112 | A1 | 8/2012 | Gwosdz et al. |
| 2014/0034011 | A1 | 2/2014 | Gegg et al. |
| 2018/0363571 | A1 | 12/2018 | Larsson et al. |

FOREIGN PATENT DOCUMENTS

| | | | |
|---|---|---|---|
| DE | 102011010069 | A1 | 8/2012 |
| EP | 2481905 | A1 | 8/2012 |
| EP | 2693022 | A1 | 2/2014 |
| WO | 2017097331 | A1 | 6/2017 |

* cited by examiner

METHOD FOR STARTING A COMBUSTION ENGINE

CROSS REFERENCE TO RELATED APPLICATION

This application claims priority of European patent application no. 18 187 393.6, filed Aug. 3, 2018, the entire content of which is incorporated herein by reference.

FIELD OF THE INVENTION

The disclosure relates to a method for starting a combustion engine in a handheld, portable work apparatus, wherein a tool of the work apparatus has a drive connection via a centrifugal clutch to the crankshaft of the combustion engine. The centrifugal force coupling drives the tool when the rotational speed of the combustion engine exceeds a coupling rotational speed of the centrifugal clutch. For controlling the rotational speed of the combustion engine, an operating unit is provided that intervenes in the ignition depending on the determined rotational speed of the combustion engine.

BACKGROUND OF THE INVENTION

Combustion engines in handheld, portable work apparatuses are usually started by hand, for example, via a pull rope starter. When starting it is advantageous if the centrifugal force coupling does not close uncontrollably, so that the tool is separated from the driving crankshaft of the combustion engine during the starting process.

In addition, for example, due to defects in the mixture formation device, undesirable operating states of the combustion engine may occur, which may result in an excessive rotational speed of the combustion engine when starting.

SUMMARY OF THE INVENTION

It is an object of the invention to provide a method for starting a combustion engine, by which undesirable operating states of the combustion engine are detected in order to ensure safe starting of the combustion engine.

The object can, for example, be achieved in that when starting, start rpm limiting becomes active and intervenes in the ignition of the combustion engine if the rotational speed of the combustion engine exceeds the coupling rotational speed of the centrifugal force coupling.

If the rotational speed does not increase above the activation rotational speed when starting and running up the combustion engine, the start rpm limiting remains switched off or remains in a "standby" mode in which it does not interfere with the operation of the combustion engine. The start rpm limiting remains inactive.

If the activation rotational speed is exceeded, the start rpm limiting intervenes in the ignition for at least one working cycle of the combustion engine in such a way that the rotational speed of the combustion engine decreases. After the rotational speed of the combustion engine drops below a lower engagement rotational speed, intervention in the ignition is again carried out in such a way that the rotational speed of the combustion engine rises again. The lower engagement rotational speed is below an upper engagement rotational speed by a rotational speed gap. Preferably, the upper engagement rotational speed may be equal to or less than the activation rotational speed. As soon as the increasing speed of the combustion engine exceeds the upper engagement rotational speed, the start rpm limiting again intervenes in the ignition in such a way that the rotational speed drops again. The start rpm limiting can set the rotational speed of the combustion engine within the rotational speed corridor between the upper engagement rotational speed and the lower engagement rotational speed. Here it is advantageously provided that the upper engagement rotational speed and/or the lower engagement rotational speed is/are changed with an increasing number of consecutive working cycles.

The upper engagement rotational speed is a rotational speed limit. The upper engagement rotational speed can also be referred to as the upper rotational speed threshold, on the overshooting of which the ignition is changed to reduce the speed. Accordingly, the lower engagement rotational speed is a rotational speed limit. The lower engagement rotational speed can also be referred to as the lower rotational speed threshold, at which the ignition is changed to increase the speed.

With the method, reliable starting of the combustion engine is possible while avoiding undesirable operating states.

Advantageously, after running up the combustion engine, the upper engagement rotational speed and/or the lower engagement rotational speed are reduced. In particular, the upper engagement rotational speed is reduced to below the coupling rotational speed. This ensures that the rotational speed of the combustion engine is guided below the coupling rotational speed after starting and running up the combustion engine. After reducing the upper engagement rotational speed, the combustion engine is operated with a safe rotational speed gap below the coupling rotational speed.

The ignition can be changed by adjusting the ignition timing. Advantageously, the ignition is changed by switching off and switching on the ignition.

In an embodiment, the upper engagement rotational speed may be an ignition deactivation rotational speed, which advantageously forms an upper rotational speed threshold. When the ignition deactivation rotational speed is exceeded, the ignition is switched off.

Advantageously, the lower engagement rotational speed can be an ignition activation rotational speed, which advantageously forms a lower speed threshold. If the rotational speed falls below ignition activation rotational speed, the ignition is switched on.

Advantageously, the upper engagement rotational speed is formed as a characteristic line over successive working cycles. In the same way, the lower engagement rotational speed can be formed as a characteristic line over successive working cycles.

The characteristic line is understood not only as a stored characteristic line, but also a characteristic line field that is stored in a memory and/or characteristic lines specified or generated by algorithms. For example, by entering the determined rotational speed into a predetermined algorithm, it can be checked whether, depending on a variable such as the number of working cycles counted after starting and running up the combustion engine, a rotational speed limit such as an upper and/or a lower engagement rotational speed is exceeded or undershot.

After a successful start and run-up of the combustion engine, the characteristic lines of the upper engagement rotational speed and the lower engagement rotational speed run parallel to each other at least in sections after a predetermined number of working cycles, in particular largely in parallel. Advantageously, it is provided to change the characteristic lines of the upper engagement rotational speed and/or the lower engagement rotational speed with the number of continuous working cycles. Appropriately, the characteristic lines of the upper engagement rotational speed and the lower engagement rotational speed are lowered by an equal amount. The change of the characteristic lines is preferably carried out jointly. It may be advantageous to lower the characteristic lines of the upper engagement rotational speed and the lower engagement rotational speed by a different amount. In particular, it is provided that after a predetermined number of working cycles the upper engagement rotational speed lies at a safe rotational speed gap below the coupling rotational speed of the centrifugal clutch.

The activation rotational speed, which may be formed in particular as a characteristic line plotted over continuous working cycles, may be equal to or greater than the upper engagement rotational speed. Preferably, the characteristic line is constant and runs in particular horizontal to the X axis. The activation rotational speed preferably forms a fixed activation threshold. The activation rotational speed is preferably not changed during the course of the procedure. The activation rotational speed is a fixed rotational speed value. It may be appropriate to provide for a variable activation rotational speed over the working cycles. Advantageously, the activation rotational speed is not below the upper engagement rotational speed.

In an embodiment, after the expiry of a first time window after the combustion engine is started, exceeding the upper engagement rotational speed can be allowed if the condition has been met that the rotational speed of the combustion engine is below the upper engagement rotational speed during the entire duration of the first time window. The first time window preferably starts with the first crankshaft revolutions when the combustion engine is started, in particular with the first crankshaft rotation. The first time window is started when a first voltage of a generator driven by the crankshaft is applied. Advantageously, the start rpm limiting can be switched off if individual or several operating parameters are met for switching off the start rpm limiting, for example, depending on an operating change signal of the combustion engine or the ignition control thereof as described in the applicant's patent application US 2012/0193112, to the disclosure of which reference is made here.

If the rotational speed of the combustion engine exceeds the activation rotational speed, especially during the duration of the first time window, a second time window is started. The combustion engine is switched off if the rotational speed of the combustion engine is not steadily below the upper engagement rotational speed for the duration of a third time window.

To reconcile the procedure, it is appropriate if the duration of the second window is advantageously longer than the duration of the first time window and/or the duration of the third window. In particular, the duration of the second time window is longer than the duration of the third time window by at least a multiple. In particular, the duration of the first time window is longer than the duration of the third time window.

In operation, the start rpm limiting is restarted each time the lower engagement rotational speed is undershot and an intervention in the ignition occurs. Exceeding the upper engagement rotational speed may be permitted if no further intervention in the ignition to lower the rotational speed is carried out during the duration of the third time window.

The method is advantageous in particular in the case of combustion engines to be started by a pull rope starter.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
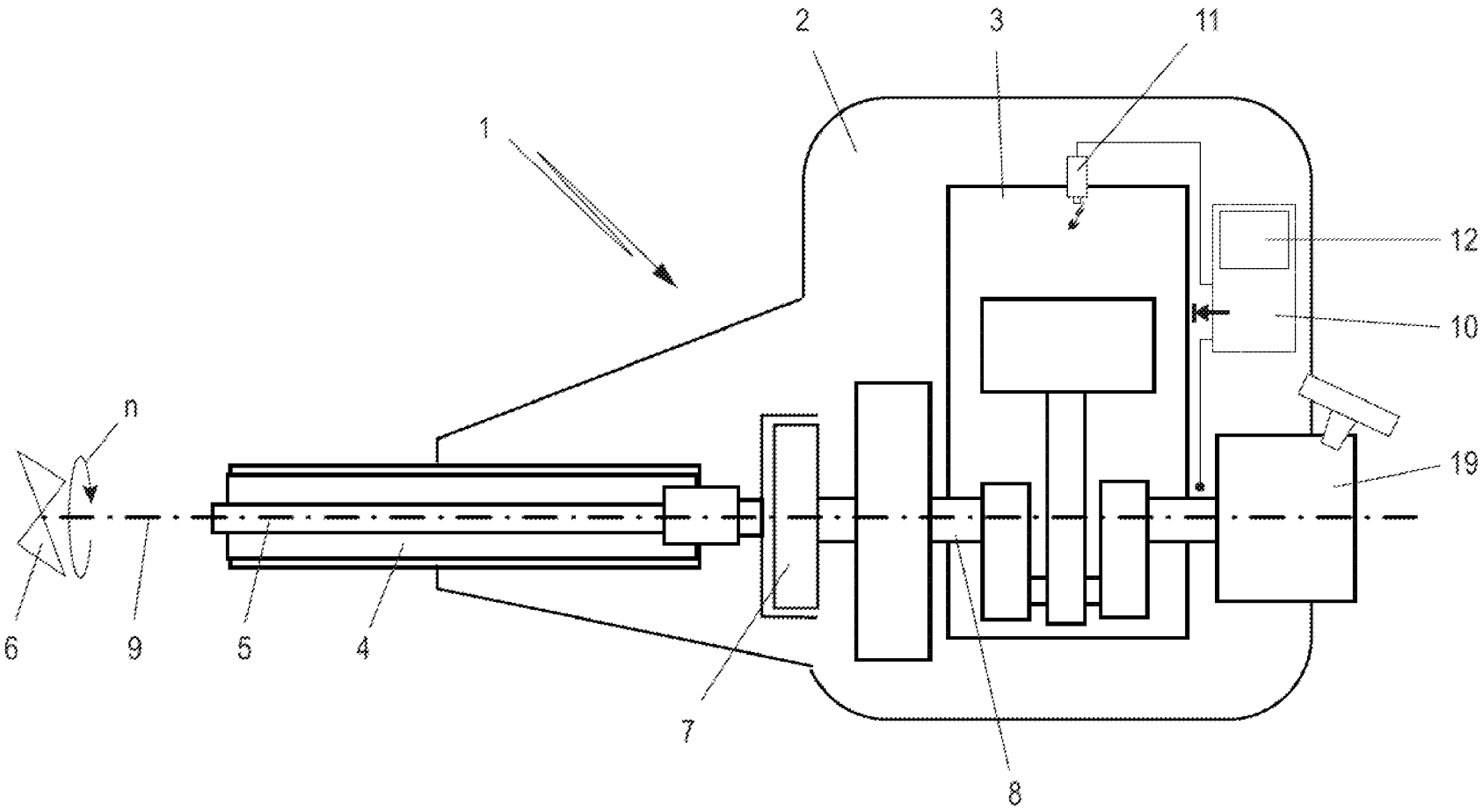
FIG. 1 shows in a schematic representation a handheld, portable work apparatus using the example of a brushcutter.

The work apparatus schematically represented in FIG. 1 has a housing 2 with a combustion engine 3 arranged therein. The work apparatus 1 shown by way of example is a brushcutter, which drives an unspecified tool 6 that is not shown in detail via a drive shaft 5 supported in a guide tube 4. The drive shaft 5 of the tool 6 has a drive connection to the crankshaft 8 of the combustion engine 3 via a centrifugal force coupling 7. The crankshaft 8 rotates around a rotation axis 9 with a rotational speed n. The rotational speed n corresponds to the rotational speed of the combustion engine 3. The combustion engine 3 is advantageously started by a pull rope starter 19, by a spring starter or by an electric starter motor.

Other handheld, in particular portable handheld work apparatuses may include motorized chainsaws, hedge trimmers, pruners, blowers, drills, sprayers or the like.

If the rotational speed n of the combustion engine 3 exceeds a coupling rotational speed EKD (FIG. 2), the centrifugal force coupling 7 establishes a torque-transmitting connection between the crankshaft 8 and the drive shaft 5 of the tool 6 and drives the tool 6.

The combustion engine 3 includes an operating unit 10 for controlling the rotational speed n of the combustion engine 3, wherein the operating unit 10 controls the ignition 11 of the combustion engine 3 for adjusting the rotational speed n. Depending on the rotational speed n of the combustion engine 3, the ignition 11 is changed. If the rotational speed n exceeds a predetermined upper engagement rotational speed 49 (FIG. 2), the operating unit 10 intervenes in the ignition 11 in such a way that the rotational speed drops. If the rotational speed n falls below a lower engagement rotational speed 47 (FIG. 2), an intervention into the ignition 11 takes place in such a way that the rotational speed n rises again.

A start rpm limiting 12 is embodied in the operating unit 10. The start rpm limiting 12 can also be provided as a separate unit. The start rpm limiting 12 will intervene in the ignition depending on an activation rotational speed ADZ. The start rpm limiting is on "standby" when the combustion engine is started, but only intervenes in the ignition 11 if the rotational speed n of the combustion engine 3 exceeds the activation rotational speed ADZ. If the rotational speed n of the combustion engine 3 has exceeded the activation rotational speed ADZ once, the start rpm limiting 12 is active. The revolution rate limiting intervenes in the ignition. When the start rpm limiting 12 is active, the rotational speed n of the combustion engine 3 is controlled according to predetermined criteria of the method, which is described in detail below.

In the method, the start rpm limiting 12 will intervene in the ignition 11 if the rotational speed n of the combustion engine 3 exceeds an activation rotational speed ADZ that lies above the coupling rotational speed EKD. After activating the start rpm limiting 12 for at least one working cycle ASP of the combustion engine 3, the start rpm limiting 12 intervenes in the ignition 11 of the combustion engine 3 in such a way that the rotational speed n of the combustion engine 3 decreases. If the rotational speed n of the combustion engine 3 falls below the lower engagement rotational speed 47, an intervention in the ignition 11 is carried out in such a way that the rotational speed n rises again. If the rotational speed n of the combustion engine 3 exceeds the upper engagement rotational speed 49, in order to lower the rotational speed n an intervention in the ignition 11 is carried out again in such a way that the rotational speed n decreases again. The upper engagement rotational speed 49 and/or the lower engagement rotational speed 47 is/are changed with an increasing number of consecutive working cycles ASP (FIG. 2).

In the following, a method is described on the basis of an ignition deactivation rotational speed ATD and an ignition activation rotational speed ETD, which are formed in particular as characteristic lines. The characteristic lines can be stored characteristic lines or characteristic line fields or can also be represented by an algorithm. The ignition deactivation rotational speed ATD forms the upper engagement rotational speed. The ignition activation rotational speed forms the lower engagement rotational speed.

Figure 2:
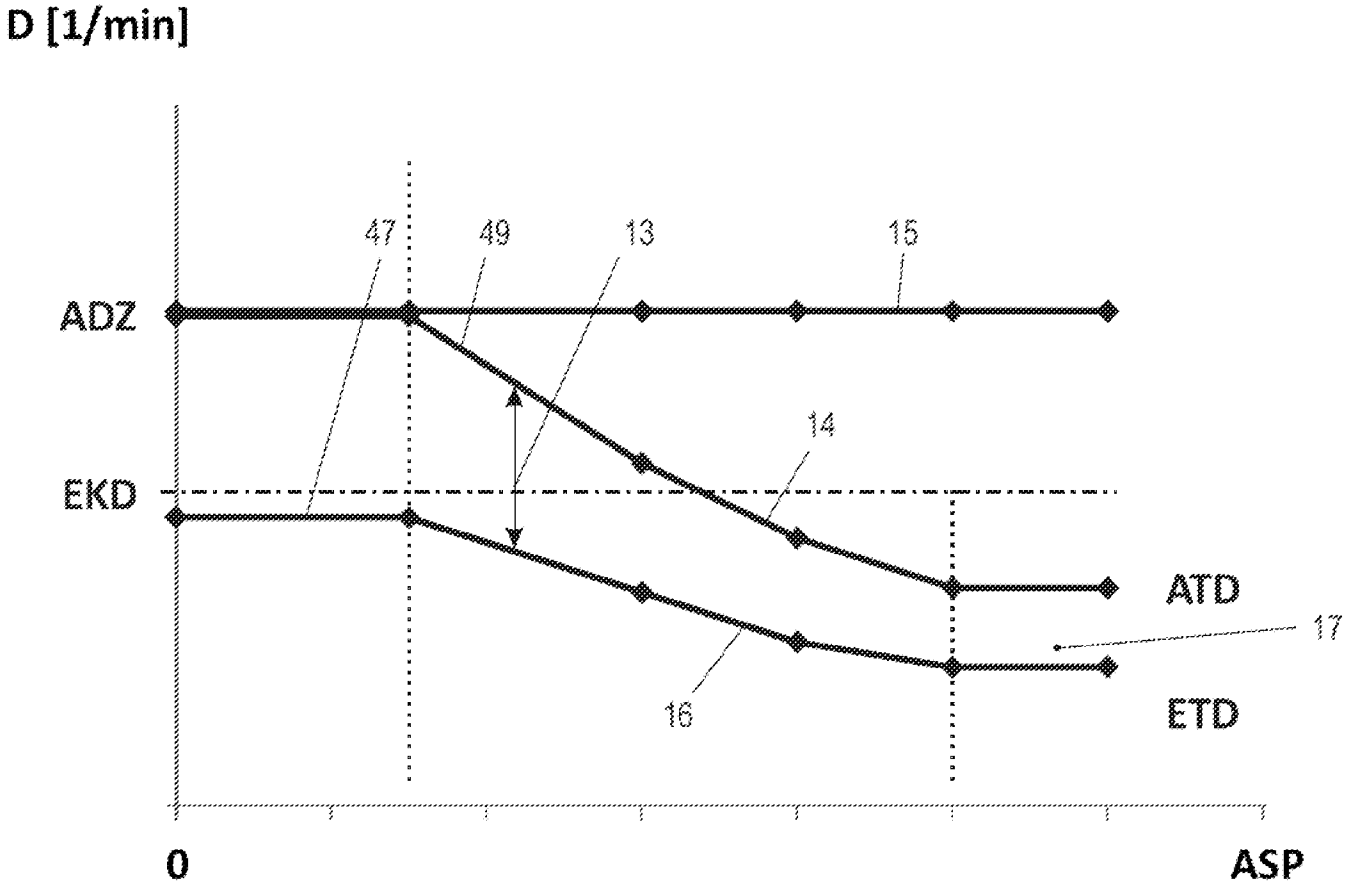
FIG. 2 shows a schematic representation of the characteristic lines of an activation rotational speed, an ignition deactivation rotational speed as the upper engagement rotational speed and an ignition activation rotational speed as a lower engagement rotational speed, plotted over successive working cycles after the start and run-up of the combustion engine.

In the diagram according to FIG. 2 the rotational speed n [1/min] of the combustion engine 3 is plotted on the Y-axis. The number of consecutive work cycles ASP after starting and running up the combustion engine 3 is plotted on the X-axis. A working cycle ASP with a two-stroke engine corresponds to a crankshaft rotation of 360° kW. In a four-stroke engine, a working cycle ASP corresponds to two crankshaft rotations, that is, 720° kW.

If the combustion engine 3 is running up when started in particular by a manual pull rope starter 19, the rotational speed n can increase sharply within the first working cycles ASP and can exceed the activation rotational speed ADZ. If the rotational speed n of the combustion engine 3 exceeds the activation rotational speed ADZ, the start rpm limiting 12 becomes active and intervenes in the ignition to reduce the rotational speed.

The activation rotational speed ADZ is represented in FIG. 2 and lies above the coupling rotational speed EKD.

In FIG. 2 the ignition deactivation rotational speed ATD is also shown as a characteristic line 14 over successive working cycles ASP. The ignition activation rotational speed ETD is shown as a characteristic line 16 over successive working cycles ASP. As shown in FIG. 2, the characteristic lines 14 and 16 of the ignition deactivation rotational speed ATD and the ignition activation rotational speed ETD decrease after the combustion engine 3 is started. The characteristic lines 14 and 16 of the ignition deactivation rotational speed ATD and the ignition activation rotational speed ETD change and decrease with consecutive working cycles ASP. Advantageously, the characteristic lines decrease by about the same amount. The characteristic line 15 of the activation rotational speed ADZ plotted over the working cycles ASP can remain advantageously the same over the working cycles ASP. Advantageously, the activation rotational speed ADZ is also changed over the working cycles ASP, in particular lowered.

If the rotational speed n of the combustion engine 3 in the first working cycles ASP exceeds the activation rotational speed ADZ, on the one hand the start rpm limiting 12 is activated and on the other hand the ignition 11 is changed for at least one working cycle ASP of the combustion engine 3. In an embodiment of the method, the ignition 11 is switched off. The ignition 11 is then changed again, preferably switched on, if the rotational speed n of the combustion engine 3 falls below the characteristic line 16 of the ignition activation rotational speed ETD.

The characteristic line 14 of the ignition deactivation rotational speed ATD and the characteristic line 16 of the ignition activation rotational speed ETD have a rotational speed gap 13 relative to each other. The characteristic line 14 of the ignition deactivation rotational speed ATD and the characteristic line 16 of the ignition activation rotational speed ETD decrease with an increasing number of working cycles ASP. Following a predetermined number of consecutive working cycles, the characteristic lines 14, 16 advantageously run parallel to each other at least over a characteristic line section. Advantageously, a rotational speed corridor 17 extending over the working cycles is formed between the characteristic lines 14, 16. The characteristic lines 14 and 16 delimit the rotational speed corridor 17. The rotational speed corridor 17 advantageously becomes narrower with an increasing number of consecutive working cycles ASP. The rotational speed gap is halved over the first working cycles. The above rotational speed values are given by way of example.

Figure 3:
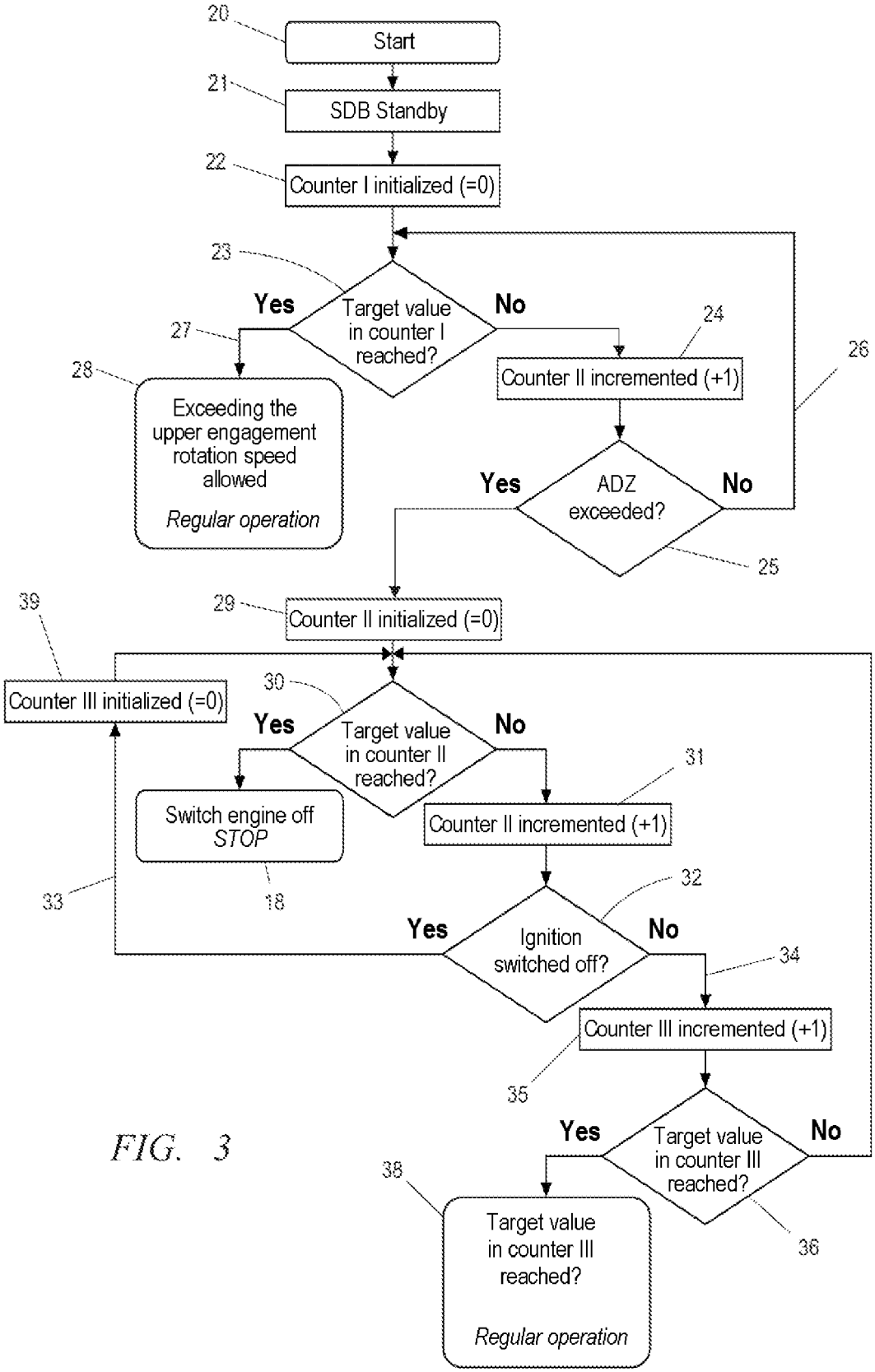
FIG. 3 shows a schematic flow diagram of a method for starting the combustion engine in a handheld, portable work apparatus.

A sequence of the method is shown in the schematic flow diagram in FIG. 3. When starting the combustion engine in the start field 20, the start rpm limiting 12 is in "standby mode" as specified in field 21. In the following field, a counter I is initialized, which starts a first time window 40 with a duration T1. The time window 40 is started with the start of the combustion engine 3. The initialization sets the counter I to "zero". In the decision rhombus 23, the current counter state of the counter I is queried. The duration T1 of the time window 40 is determined by a predetermined target value of the counter I. If the duration T1 of the time window 40 has not yet expired, the counter I has not yet reached its target value. The decision rhombus 23 branches to the NO-branch, and the counter state of the counter I is incremented by the value "1" (field 24). The counter state is increased by an increment. Afterwards, in the decision rhombus 25 a query is made as to whether the activation rotational speed ADZ has been exceeded. If this is not the case, the decision rhombus 25 leads back via the NO-branch 26 to the query regarding the current counter state of the counter I. If the rotational speed n of the combustion engine 3 lies below the ignition deactivation rotational speed ATD for the entire duration T1 of the time window 40 (FIG. 4), the counter I is incremented by an increment until the counter I reaches its specified target. Once the target value in the counter I has been reached, proper operation of the combustion engine 3 is assumed. The decision rhombus 23 branches to the field 28 via the branch 27 (YES-branch). Field 28 allows an increase in the rotational speed n of the combustion engine 3 above the ignition deactivation rotational speed (upper engagement rotational speed) so that the combustion engine goes into regular operation. In regular operation, the user can increase the rotational speed n of the combustion engine beyond the upper engagement rotational speed and the coupling rotational speed EKD via the throttle lever in order to work with the work apparatus 1 as intended. This procedure after the start of the combustion engine is also reproduced in FIG. 4. The counter I, which determines the time window 40 of duration T1 with its given target value, can run undisturbed, since according to the indicated rotational speed curve 41 the rotational speed n lies in the range of the rotational speed corridor 17 between the ignition deactivation rotational speed ATD and the ignition activation rotational speed ETD.

Figure 5:
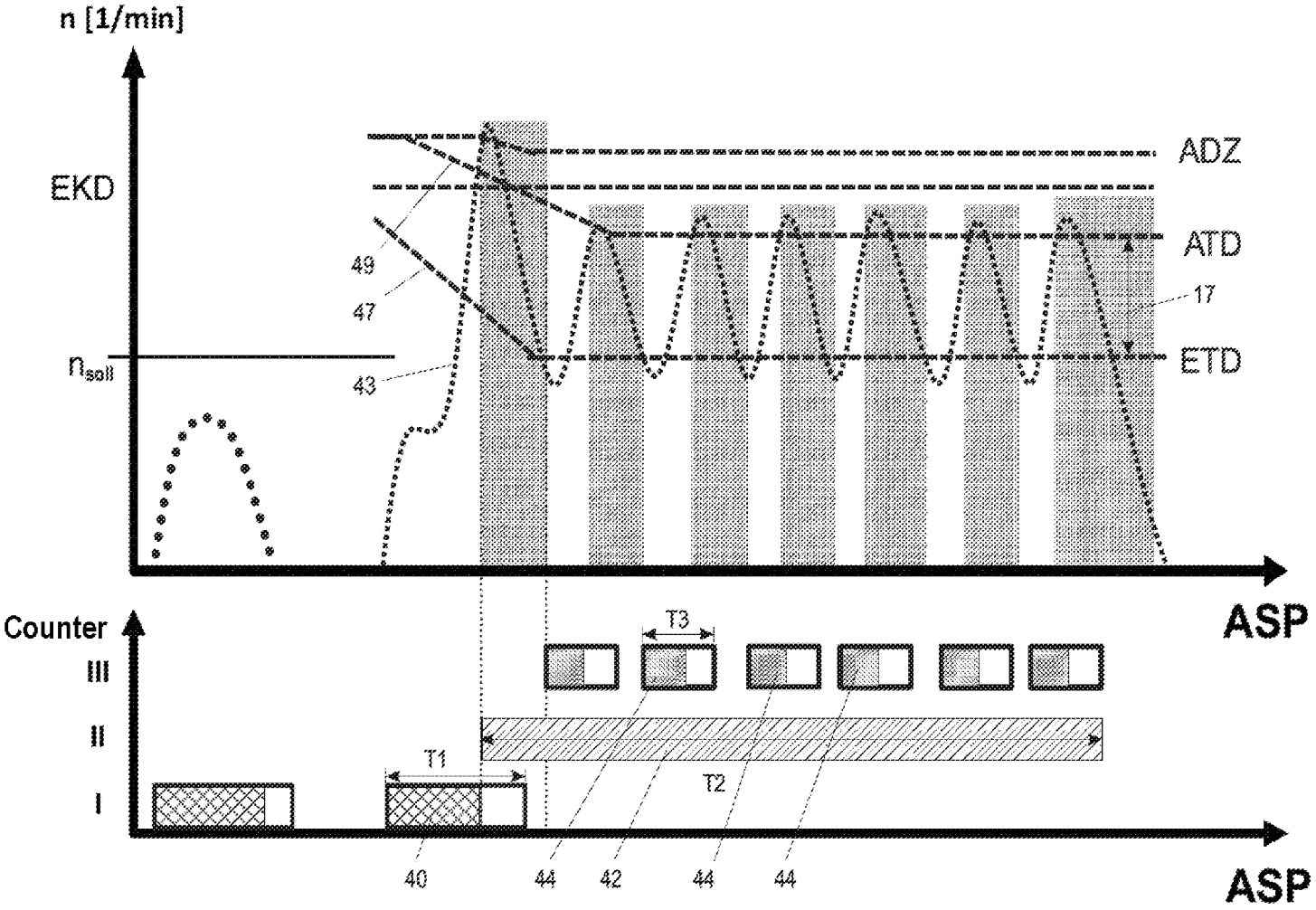
FIG. 5 shows a schematic representation of a rotational speed curve between the ignition deactivation rotational speed as the upper engagement rotational speed and the ignition activation rotational speed as the lower engagement rotational speed similar to FIG. 4 with repeated instances of exceeding the ignition deactivation rotational speed and falling below the ignition activation rotational speed; and, FIG. 6 shows a schematic representation of a rotational speed curve between the ignition deactivation rotational speed as the upper engagement rotational speed and the ignition activation rotational speed as the lower engagement rotational speed similar to FIG. 5 with a few instances of exceeding the ignition deactivation rotational speed and falling below the ignition activation rotational speed.
Figure 6:
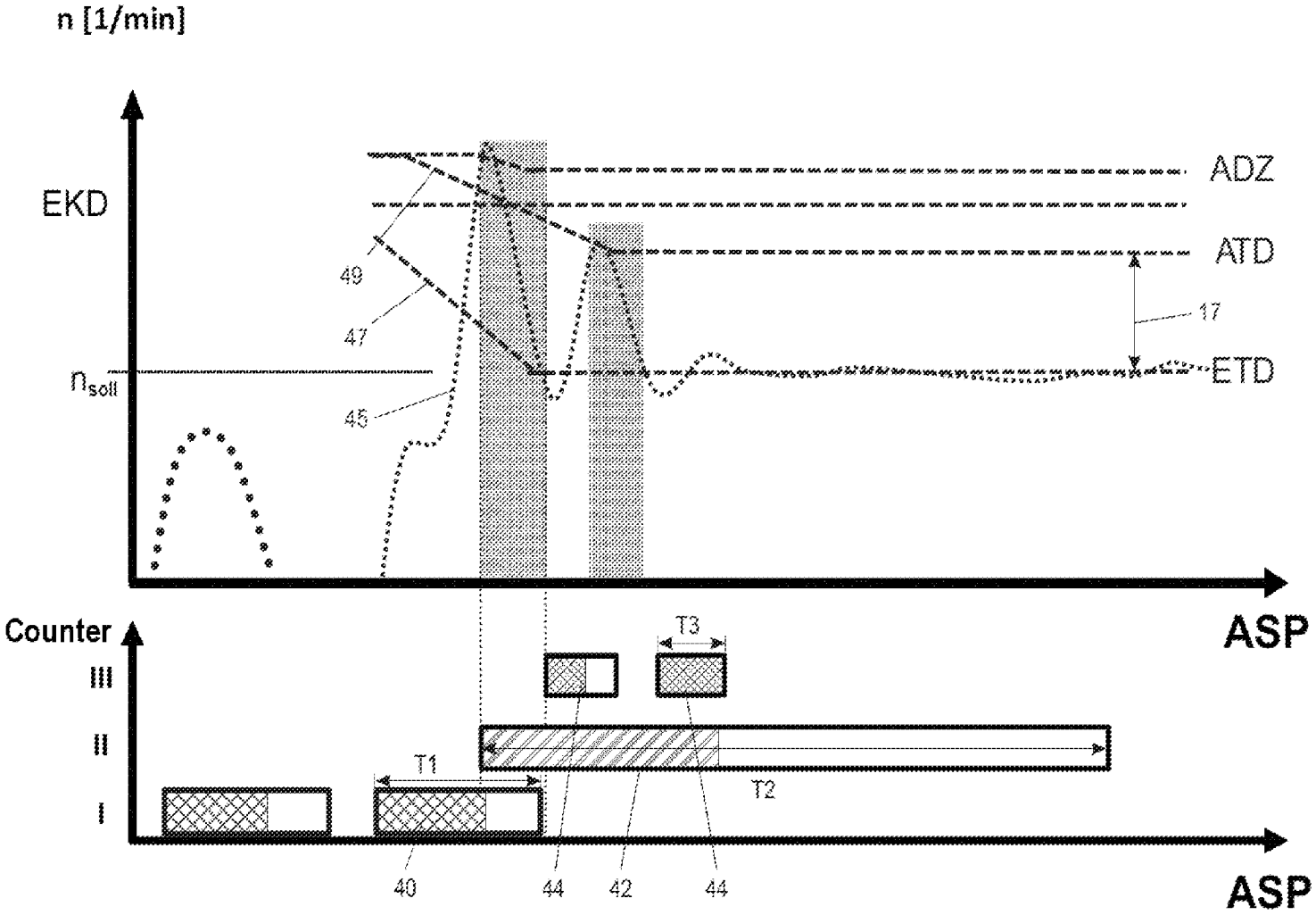

If, for example, during the duration T1 of the time window 40 it is determined in the decision rhombus 25 (FIG. 3) that the activation rotational speed ADZ has been exceeded, the decision rhombus 25 branches to another counter II. A target value specified for the counter II determines the duration T2 of a second time window 42 (FIGS. 5, 6). The counter II is initialized in field 29 when the activation rotational speed ADZ is exceeded. Initialization sets the counter state to zero. The counter state of the counter II is queried in the decision rhombus 30. If the duration T2 of the time window 42 has expired, the counter II has reached its predetermined target value. If the counter state of the counter II has reached the target value, the decision rhombus 30 branches via the YES-branch to the "engine stop" field 18. If this is the case, the combustion engine 3 is switched off. There may be an undesirable function that may interfere with proper operation of the combustion engine 3.

Achieving the predetermined target value in the counter II is shown in the representation according to FIG. 5. The predetermined target value of the counter II corresponds to the duration T2 of the second time window 42. During the entire time period T2, the rotational speed curve 43 may oscillate between the ignition deactivation rotational speed ATD and the ignition activation rotational speed ETD, indicating an undesirable operating state. In each case, the ignition deactivation rotational speed ADZ is exceeded and the ignition 11 is switched off and—following a decrease in the rotational speed—the ignition activation rotational speed ETD is undershot and the ignition 11 is switched on again.

If the counter state in counter II has not yet reached its target value, the counter state of the counter II is increased by an increment via the decision rhombus 30 in field 31 (FIG. 3). Thereafter, the decision rhombus 32 is queried as to whether a switch-off of the ignition 11 was issued, that is, an intervention in the ignition, for example, by deactivating the ignition 11. If the ignition 11 was switched off, the YES-branch 33 of the decision rhombus 32 leads back to the decision rhombus 30 in order to check the counter state of the counter II again. The field 39, in which another counter III is initialized, also lies in the YES-branch 33 to the decision rhombus 30.

As long as there is an intervention in the ignition 11, such as the ignition being deactivated for example, advantageously the ignition 11 is switched off, the decision rhombus 32 branches via the YES-branch 33 back to the decision rhombus 30 until the target value of the counter II is reached. The decision rhombus 30 then branches to the engine stop field 18. The combustion engine 3 is accordingly switched off. With each return via the YES-branch of the decision rhombus 32 to query the counter state of the counter II in the decision rhombus 30, the counter III is set to "zero". A target value equal to the duration T3 of a third time window 44 (FIGS. 4, 5) is specified for the counter III.

If the ignition has not been deactivated in a working cycle ASP, advantageously switched off, the decision rhombus 32 branches via the NO-branch 34 to the field 35, in which the counter state of the counter III is increased by an increment. Afterwards, the decision rhombus 36 is used to check whether the counter state of the counter III has reached the set target value. The target value of the counter III corresponds to the duration T3 of the third time window 44. If the duration T3 has expired, which is recognized by reaching the target value of the counter state of the counter III, the decision rhombus 32 branches via the YES-branch to the field 38. Field 38 allows an increase in the rotational speed n of the combustion engine 3 to above the ignition deactivation rotational speed (upper engagement rotational speed) so that the combustion engine 3 goes into regular operation.

Alternatively, it can be checked in field 38 whether a shutdown criterion exists for switching off the start rpm limiting 12 and whether the combustion engine 3 can be changed to regular operation. A shutdown criterion may be an operating change signal of the combustion engine or its ignition control, as described by way of example in patent application US 2012/0193112 of the applicant. If there is a shutdown criterion, the combustion engine 3 is switched to an operating mode for working with the work apparatus 1.

If, on the other hand, the duration T3 of the third time window 44 has not expired, that is, in the embodiment shown the target value of the counter III has not yet been reached, the decision rhombus 36 branches to the NO-branch and leads back to the input of the decision rhombus 30. In the decision rhombus 30, it is again checked whether the target value of the counter II has been reached, that is, whether the duration T2 of the second time window 42 has expired.

The counter III forms a third time window 44 with the duration T3 and is reinitialized each time the ignition 11 has been switched off. This is the result of FIG. 3, in which the decision rhombus 32 branches to field 39 via the YES-branch 33. In the YES-branch branch 33, the counter state of the counter III is reset to "zero" in each case.

From FIG. 5 it is also clear that on exceeding the activation rotational speed ADZ the second time window 42 with the duration T2 is started and after switching on the ignition 11 the third time window 44 with the duration T3 is started if the ignition activation rotational speed ETD is exceeded by the rotational speed curve 43. If the rotational speed curve 43 exceeds the ignition deactivation rotational speed ATD after activating the second time window 42, the ignition 11 is switched off. As with the schematic flowchart according to FIG. 3, in this case the decision rhombus 32 branches via the YES-branch 33 back to the input of the decision rhombus 30, whereby at the same time the counter state of the counter III is cleared or the counter III is re-initialized. The counter III counts again from "zero" if the ignition 11 is switched on again. The duration T3 of the third time window 44 starts again.

If during the duration T2 of the second time window 42, the rotational speed curve 45 runs below the ignition deactivation rotational speed ATD as shown in FIG. 6, the duration T3 of the third time window 44 can run undisturbed, so that—as shown in FIG. 3—the decision rhombus 36 branches to the field 38. Upon reaching field 38, the combustion engine 3 is switched to regular operation for working with the work apparatus 1.

A comparison of FIGS. 5 and 6 shows that after exceeding the activation rotational speed ADZ, the second time window 42 starts with the duration T2. The combustion engine 3 is advantageously switched off if its rotational speed n does not fall below the ignition deactivation rotational speed ATD for the duration T3 of the third time window 44. In the illustration according to FIG. 5, the rotational speed curve 43 exceeds the ignition deactivation rotational speed ATD after switching on the ignition 11, so that the third time window 44 cannot expire. In FIG. 6 the rotational speed curve 45 levels off below the ignition deactivation rotational speed ATD, so that the duration T3 of the third time window 44 can expire, which indicates stable operation of the combustion engine 3.

Figure 4:
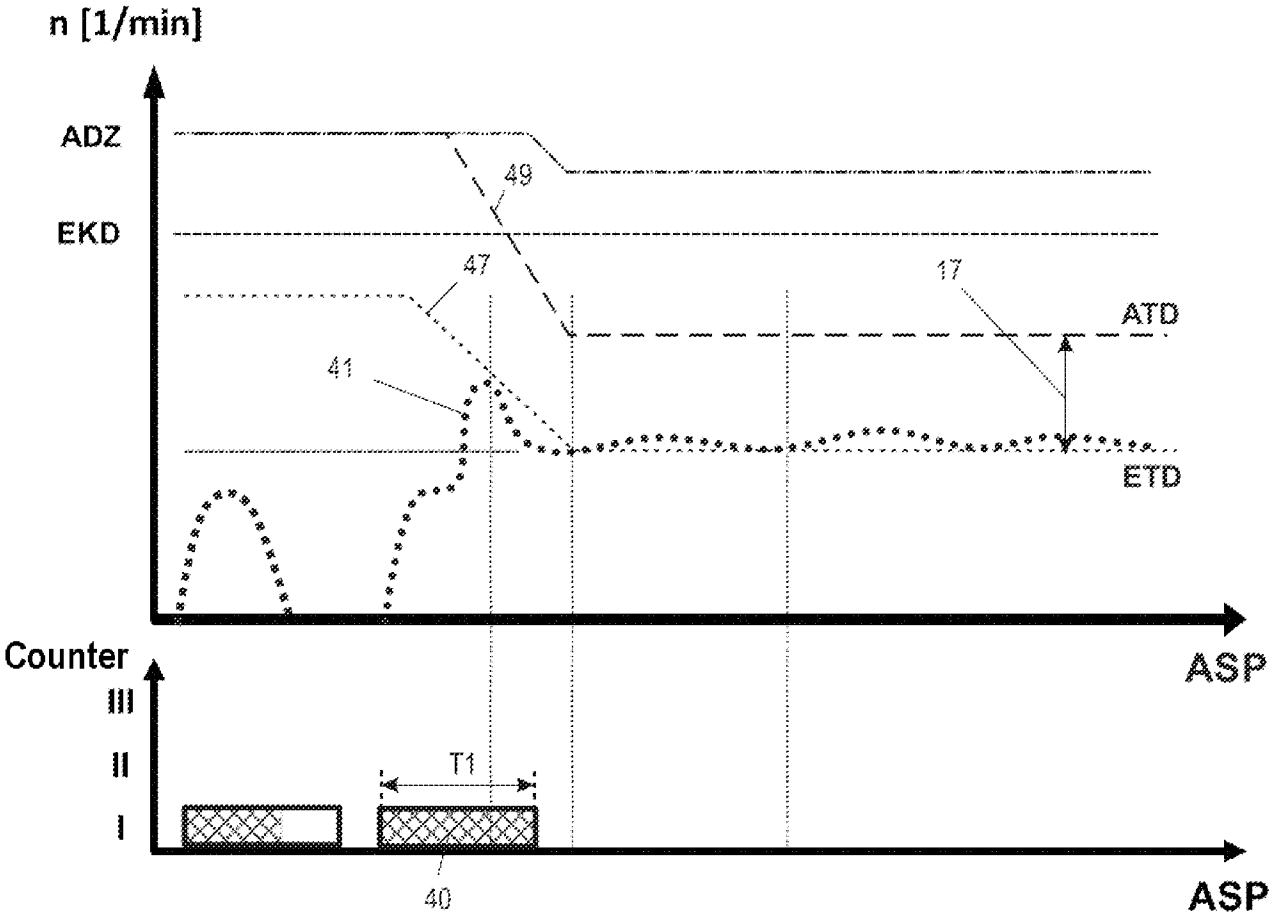
FIG. 4 shows a schematic representation of an approved rotational speed curve between the ignition deactivation rotational speed as the upper engagement rotational speed and the ignition activation rotational speed as the lower engagement rotational speed when a combustion engine is started.

As can further be seen from FIGS. 4 to 6, the duration T2 of the second time window 42 is longer than the duration T1 of the first time window 40 and/or the duration T3 of the third time window 44. In particular, the duration T2 of the second time window 42 is longer than the duration T3 of the third time window by a multiple. The duration T2 of the second time window is three to ten times longer, in particular eight times as long as the duration T3 of the third time window 44.

FIGS. 4 to 6 also show that the duration T1 of the first time window 40 is longer than the duration T3 of the third time window 44. In the embodiment shown, the duration T1 of the first time window 40 is twice to four times as long as the duration T3 of the third time window 44. In particular, the duration T1 of the first time window 40 is twice as long as the duration T3 of the third time window 44.

The target values of the counters I, II and III are specified according to the selected duration T1 of the first time window 40, the duration T2 of the second time window 42 and the duration T3 of the third time window 44. Thus, the target value of the second counter II is greater than the target value of the first counter I and/or the target value of the third counter III. In particular, the target value of the second counter II is greater by a multiple than the target value of the third counter III.

The first time window 40 can also be called a start window. The second time window 42 can also be called a control window. The third time window 44 can also be called a monitoring window.

It is understood that the foregoing description is that of the preferred embodiments of the invention and that various changes and modifications may be made thereto without departing from the spirit and scope of the invention as defined in the appended claims.

What is claimed is:

1. A method for starting a combustion engine in a handheld, portable work apparatus, wherein the work apparatus includes a tool having a drive connection to the crankshaft of the combustion engine via a centrifugal coupling, and the centrifugal coupling drives the tool when the rotational speed (n) of the combustion engine exceeds a coupling rotational speed (EKD) of the centrifugal coupling, the work apparatus having an operating unit for controlling the rotational speed (n) of the combustion engine, wherein the operating unit controls an ignition of the combustion engine for adjusting the rotational speed (n) and changes the ignition depending on the rotational speed (n) of the combustion engine, the method comprising the steps of:

(i) intervening in the ignition via a start rotational speed limiter if the rotational speed (n) of the combustion engine exceeds an activation rotational speed (ADZ) lying above the coupling rotational speed (EKD);

(ii) decreasing the rotational speed (n) of the combustion engine by intervening in the ignition of the combustion engine via the start rotational speed limiter for at least one working cycle (ASP) of the combustion engine;

(iii) increasing the rotational speed (n) by intervening in the ignition after the rotational speed (n) of the combustion engine falls below a lower engagement rotational speed with a rotational speed gap, wherein the lower engagement rotational speed lies below an upper engagement rotational speed;

(iv) decreasing the rotational speed (n) by intervening in the ignition if the rotational speed (n) of the combustion engine exceeds the upper engagement rotational speed; and, (v) adjusting at least one of the upper engagement rotational speed and the lower engagement rotational speed with increasing numbers of successive working cycles (ASP).

2. The method of claim 1, wherein at least one of the upper engagement rotational speed and the lower engagement rotational speed is lowered.

3. The method of claim 1, wherein the upper engagement rotational speed is an ignition deactivation rotational speed (ATD); and, wherein the ignition is switched off on exceeding the ignition deactivation rotational speed (ATD).

4. The method of claim 1, wherein the lower engagement rotational speed is an ignition activation rotational speed (ETD); and, wherein the ignition is switched on when the rotational speed falls below the ignition activation rotational speed (ETD).

5. The method of claim 1, wherein the upper engagement rotational speed is embodied as a characteristic line formed over successive working cycles (ASP) and the lower engagement rotational speed as a characteristic line formed over successive working cycles (ASP).

6. The method of claim 5, wherein after a start of the combustion engine over successive working cycles (ASP) the characteristic lines of the upper engagement rotational speed and the lower engagement rotational speed run parallel to each other at least in sections.

7. The method of claim 6, wherein the characteristic lines of at least one of the upper engagement rotational speed and the lower engagement rotational speed are changed with successive working cycles (ASP).

8. The method of claim 7, wherein the characteristic lines of the upper engagement rotational speed and the lower engagement rotational speed are reduced by the same amount.

9. The method of claim 7, wherein the characteristic lines of the upper engagement rotational speed and the lower engagement rotational speed are reduced by a different amount.

10. The method of claim 1, wherein the activation rotational speed (ADZ) is greater than or equal to the upper engagement rotational speed.

11. The method of claim 1, wherein after the expiry of a first time window following the start of the combustion engine, exceeding the upper engagement rotational speed is permitted if the rotational speed (n) of the combustion engine is below the upper engagement rotational speed throughout an entire duration (T1) of the first time window.

12. The method of claim 11, wherein a second time window starts when the activation rotational speed (ADZ) is exceeded, and wherein the combustion engine is switched off if the rotational speed (n) of the combustion engine is not below the upper engagement rotational speed for a duration (T3) of a third time window.

13. The method of claim 12, wherein a duration (T2) of the second time window is longer than at least one of the duration (T1) of the first time window and the duration (T3) of the third time window.

14. The method of claim 12, wherein a duration (T2) of a second time window is longer than the duration (T3) of the third time window by at least a multiple.

15. The method of claim 12, wherein the duration (T1) of the first time window is longer than the duration (T3) of the third time window.

16. The method of claim 12, wherein during operation of the start rpm limiting, the third time window is restarted for each instance of the rotational speed falling below the lower engagement rotational speed and an intervention in the ignition.

17. The method of claim 12, wherein exceeding the upper engagement rotational speed is allowed if no intervention in the ignition to lower the rotational speed is carried out throughout the duration (T3) of the third time window.

18. The method of claim 1, wherein the combustion engine is started via a pull rope starter.

* * * * *